US005858091A

United States Patent [19]

Feldkamper et al.

[11] Patent Number: 5,858,091

[45] Date of Patent: Jan. 12, 1999

[54] DEVICE FOR APPLYING ADHESIVES

[75] Inventors: Richard Feldkamper; Rüdiger Duwendag, both of Lengerich, Germany

[73] Assignee: Windmöller & Hölscher, Lengerich/Westf., Germany

[21] Appl. No.: 701,609

[22] Filed: Aug. 22, 1996

[30] Foreign Application Priority Data

Sep. 4, 1995 [DE] Germany ..... 195 32 582.6

[51] Int. Cl.[6] ..... B05C 1/00

[52] U.S. Cl. ..... 118/200; 118/259; 118/261; 156/578

[58] Field of Search ..... 118/200, 259, 118/261; 156/578

[56] References Cited

U.S. PATENT DOCUMENTS

| | | | |
|---|---|---|---|
| 3,918,397 | 11/1975 | Thettu | 118/261 |
| 3,965,856 | 6/1976 | Scholl et al. | 118/261 |
| 4,351,264 | 9/1982 | Flaum et al. | 118/259 |
| 4,419,957 | 12/1983 | Voges | 118/261 |
| 4,761,200 | 8/1988 | Szeremeta | 118/259 |
| 4,986,873 | 1/1991 | Hamamura | 118/259 |
| 5,667,589 | 9/1997 | Mailander | 118/261 |
| 5,702,525 | 12/1997 | Liou | 118/200 |

FOREIGN PATENT DOCUMENTS 2070980 9/1981 United Kingdom .

*Primary Examiner*—Peter Chin
*Assistant Examiner*—Michael P. Colaianni
*Attorney, Agent, or Firm*—Evenson, McKeown, Edwards & Lenahan, PLLC

[57] ABSTRACT

A device for applying adhesives includes an adhesive chamber, the front side of which is closed by an adhesive roller with a vertical rotational axis which, in cooperation with one vertical side wall of the chamber, delimits a return gap for unremoved adhesive. A sealing roller is arranged parallel to the adhesive roller, forms a gap for the adhesive in cooperation with the adhesive application roller and is sealed relative to the other vertical side wall of the chamber by sealing elements. A glue application roller can be adjusted such that it adjoins the adhesive roller, receives preferably formatted glue sections from the adhesive roller and transfers the glue sections to the work pieces on which the glue needs to be applied. In order to prevent accumulations of the adhesive in front of the return gap which are discharged in uncontrolled fashion, a strip of flexible and/or elastic material is fastened to the side wall that delimits the return gap. The free end of the strip adjoins the surface region of the adhesive roller which enters the chamber.

4 Claims, 3 Drawing Sheets

DEVICE FOR APPLYING ADHESIVES

BACKGROUND OF THE INVENTION

1. Field of the Invention

The invention pertains to a device for applying adhesives which comprises an adhesive chamber, the front side of which is closed by an adhesive roller with a vertical rotational axis which, in cooperation with one vertical side wall of the chamber, delimits a return gap for the unremoved adhesive. A sealing roller is arranged parallel to the adhesive roller, forms a gap for the adhesive in cooperation with the adhesive application roller and is sealed relative to the other vertical side wall of the chamber by sealing elements. A glue application roller can be adjusted such that it adjoins the adhesive roller, receives preferably formatted glue sections from the adhesive roller and transfers the glue sections to the work pieces on which the glue needs to be applied.

2. Description of Related Art

DE-PS 29 48 745 discloses a device for applying adhesives which comprises a chamber that accommodates the adhesive. The open vertical front side of the chamber is closed by an adhesive roller with a vertical rotational axis and one respective sealing roller arranged on both sides of the adhesive roller. In this case, the sealing rollers are driven in a direction opposite to the adhesive roller at a higher peripheral speed. The sealing rollers delimit gaps for the adhesive in cooperation with the adhesive roller. In addition, the sealing rollers are sealed relative to the vertical side walls of the chamber by doctor blades fastened to the sealing rollers. In this known device for applying adhesives, one side of the lateral sealing rollers delimits an outlet gap such that a film of adhesive with the desired thickness is able to form on the adhesive roller. The other side of these sealing rollers delimits an inlet gap that prevents the accumulation and uncontrolled discharge of the unremoved adhesive. The doctor blades tightly adjoin both sealing rollers so that there remains no gap through which the adhesive can be discharged from the supply container.

In one known device for applying adhesives of the initially mentioned type, the open vertical side of the glue chamber is closed by the adhesive roller and only one sealing roller. In this way, the structural design of this device is simplified to a certain degree. In this case, the sealing roller is sealed relative to the second vertical side wall of the adhesive chamber by a doctor blade fastened to the sealing roller. One disadvantage of this known device can be seen in the return gap for the unremoved adhesive between the adhesive roller and the vertical edge of the first side wall of the adhesive chamber. This disadvantage is present because turbulence that increases the pressure can occur in the adhesive chamber due to the rotating rollers. This turbulence causes an accumulation of the adhesive in front of the return gap such that the accumulated adhesive is discharged in an uncontrolled fashion and can cause bothersome soiling of the machine and system parts.

SUMMARY OF THE INVENTION

Consequently, the present invention is based on the objective of developing a device for applying adhesives of the initially mentioned type in which accumulations of the adhesive in front of the return gap which are discharged in uncontrolled fashion are prevented.

According to the invention, this objective is attained by fastening a strip of flexible and/or elastic material on the side wall that limits the return gap. The free end of the strip adjoins the surface region of the adhesive roller which enters the chamber.

The strip, according to the invention, also forms an apron that prevents a retroeffect of the pressure in the glue chamber on the return gap caused by formation of undesired accumulations of the adhesive in front of the strip which tend to be discharged in uncontrolled fashion. The strip only needs to loosely adjoin the outer surface of the adhesive roller because the strip is attracted by the outer surface of the adhesive application roller by suction due to the hydrodynamic effect of the rotating adhesive application roller. The returned adhesive flows into the glue chamber between the strip and the adhesive roller in the form of a thin film, namely within a region that is situated behind the return gap such that undesired retroeffects are precluded. This strip not only causes a smoothing of the return flow of unremoved adhesive, but also prevents turbulence within the region of the return gap because the return gap is protected and covered by the strip.

The strip can consist of an elastomer material or a cloth of textile material.

It is practical if the strip is widened from the upper side of the chamber toward the bottom of the chamber such that the hydrostatic pressure of the adhesive which increases toward the bottom is accounted for.

The utilization of the device according to the invention is not limited to a vertical arrangement of the adhesive chamber and the rollers. The open front side of the chamber can also lie on top, with the adhesive roller, the sealing roller and the adhesive application roller having correspondingly horizontal rotational axes in this case.

BRIEF DESCRIPTION OF THE DRAWINGS

One embodiment of the invention is described in detail below with reference to the figures.

DESCRIPTION OF THE PREFERRED EMBODIMENTS

Figure 2:
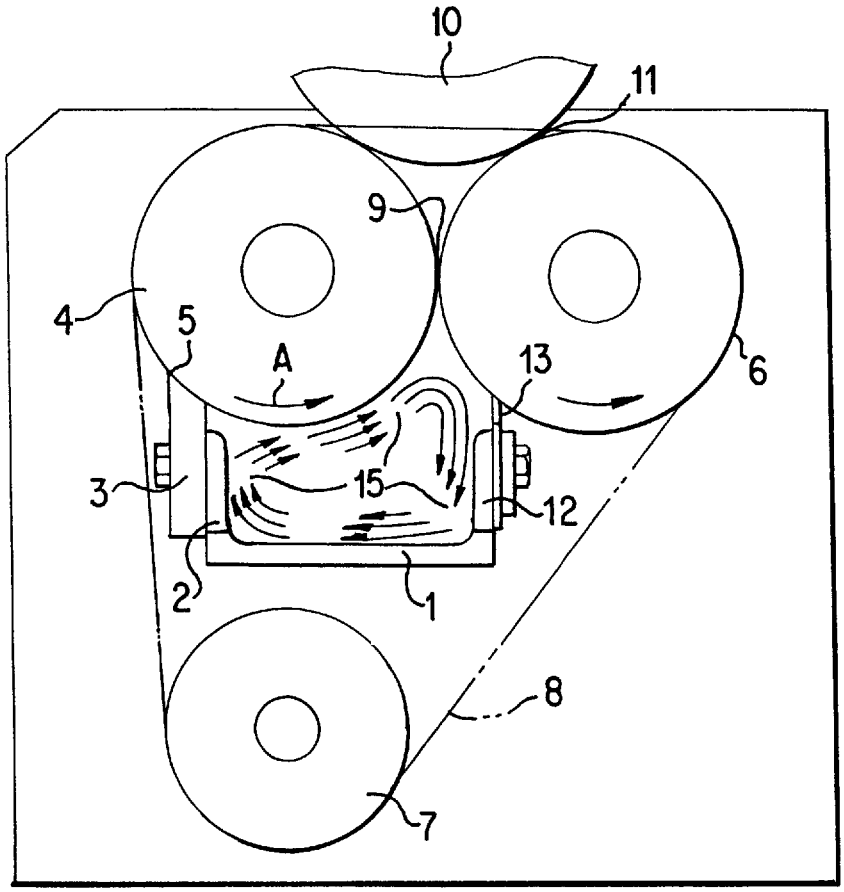
FIG. 2 PRIOR ART
FIG. 2 is a top view of a known glue application device.

FIG. 2 shows a top view of a known device for applying adhesives. In this figure, the bearing plate for the roller and the upper cover plate of the adhesive chamber are omitted to improve intelligibility. This known device consists of a U-shaped housing 1 that forms the side walls and the rear wall of the glue chamber. This housing is closed by a bottom wall and a top wall. A rail 3, the face side of which is curved in accordance with the radius of curvature of the adhesive roller 4 and, in cooperation with the adhesive roller, forms a return gap 5 for unremoved glue, is connected to the left vertical side wall 2 of the adhesive chamber 1. The rail 3 can be moved parallel to the front edge of the side wall 2 of the glue chamber 1 and fixed in predetermined positions in order to adjust the width of the return gap 5. The adhesive roller 4 rotates around its vertical axis in the direction of the arrow A. A sealing roller 6 that also rotates around a vertical axis is arranged parallel to the adhesive roller 4. This sealing roller rotates in the same direction as the adhesive roller, as indicated by the arrow. In order to drive the adhesive roller and the sealing roller 6, a pulley or a toothed pulley 7 is provided, with a belt 8 extending over the aforementioned pulley or toothed pulley that drives the respective pulleys of the rollers 4 and 6.

The sealing roller 6 and the adhesive roller 4 form a gap 9 of adjustable width such that the thickness of the adhesive film entrained by the adhesive roller can be adjusted.

An adhesive application roller 10 that also rotates around a vertical axis can be moved such that it adjoins the adhesive roller 4. The outer surface of this adhesive application roller is provided with glue application segments that are not illustrated in the figure and that correspond to the formatted glue sections to be applied. A gap 11 is provided between the sealing roller 6 and the adhesive application roller 10, with the width of this gap being sufficiently large that the two rollers do not contact one another. An adjustable doctor blade 13 that strips the adhesive from the sealing roller 6 such that the sealing roller does not entrain any adhesive toward the outside is fastened to the right vertical side wall 12 of the adhesive chamber 1.

Due to the rotation of the adhesive roller 4 and the sealing roller 6, the adhesive in the adhesive chamber 1 is subjected to a turbulent rotational movement as indicated by the arrows 15 in FIG. 2. Due to this turbulence and the pressure in the adhesive chamber, the unobstructed return of the adhesive that was not removed from the adhesive roller by the adhesive application roller may be impaired. Consequently, the adhesive may accumulate in front of the return gap 5 and be discharged in uncontrolled fashion.

Figure 1:
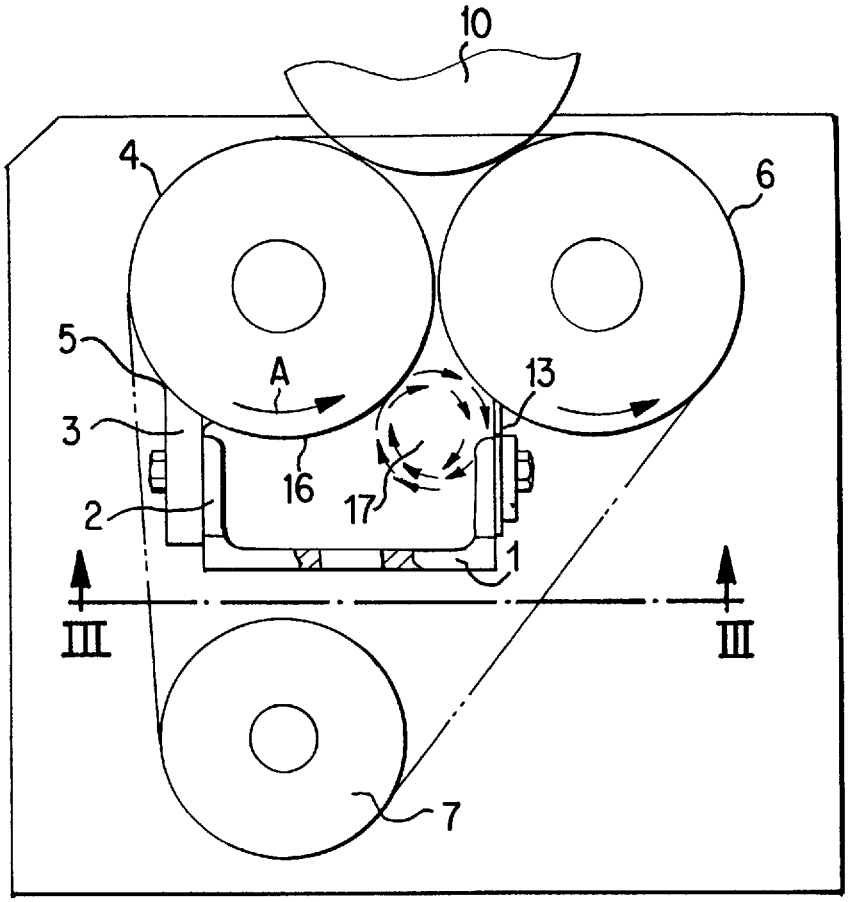
FIG. 1 is a schematic top view of the glue application device according to the invention.

The device for applying adhesives according to the invention is described below with reference to FIGS. 1 and 3. The device according to the invention is basically designed similarly to the device described previously with reference to FIG. 2, and identical components are not described anew. The device according to the invention essentially differs from the known device described previously only due to the fact that a strip 16 of flexible and/or elastic material is fastened between the left vertical side wall 2 of the adhesive chamber 1 and the rail 3 that limits the return gap 5. This strip adjoins a region of the outer surface of the adhesive roller which is situated inside of the chamber 1 filled with glue. The strip 16 prevents the hydrostatic pressure of the glue in the glue chamber 1 from directly acting upon the return gap 5. An unobstructed introduction of the unremoved and returned adhesive film, therefore, is ensured. The rollers that close the front side of the adhesive chamber 1 essentially produce only a slight turbulence 17. This turbulence, however, does not directly act upon the return gap 5 due to the apron-like strip 16. Consequently, the entire adhesive film that is returned via the return gap 5 is able to flow through the return gap 5 in unobstructed fashion, with the adhesive film being subjected to a smoothing effect before it is combined with the adhesive situated in the adhesive chamber.

Figure 3:
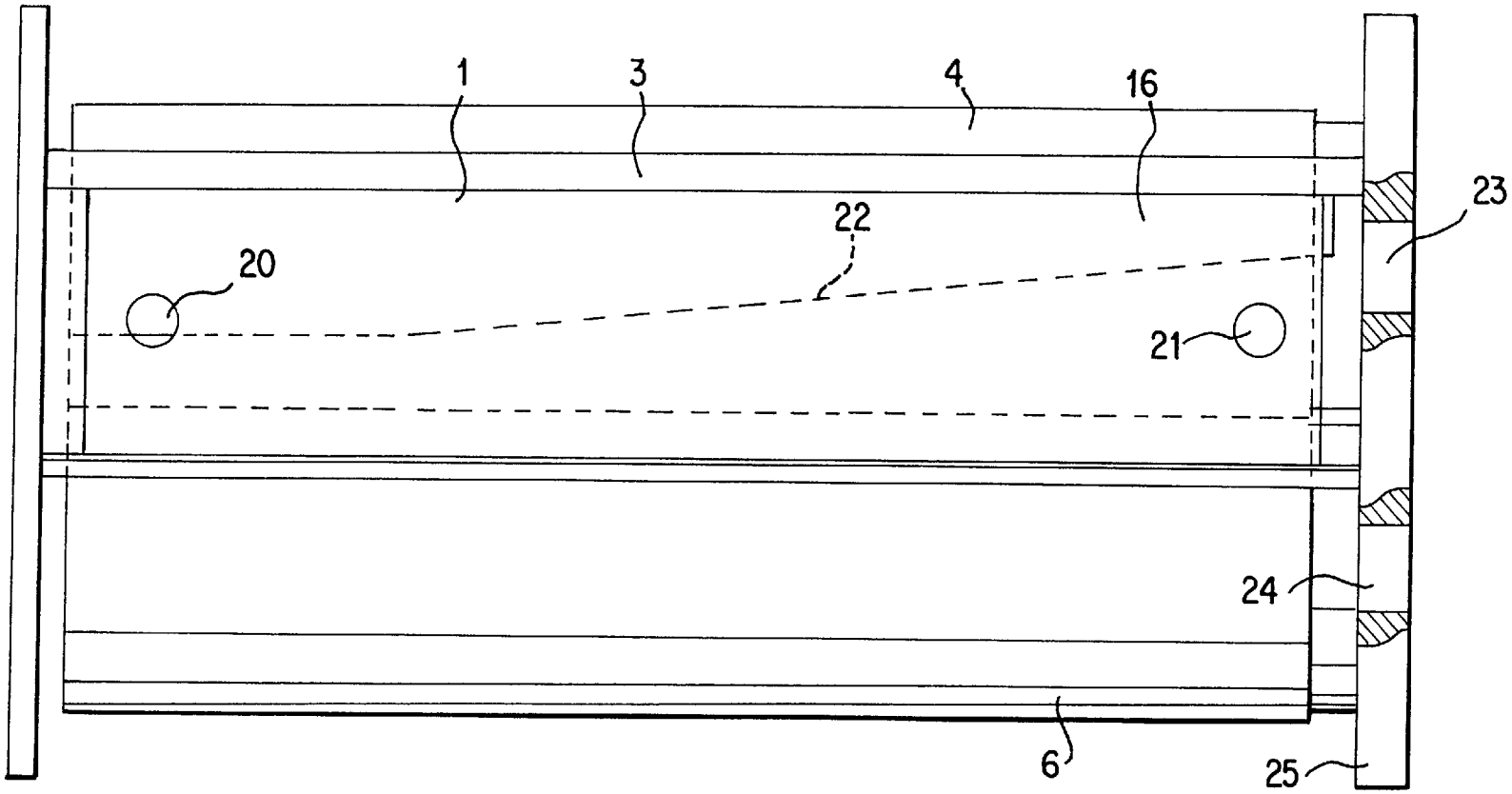
FIG. 3 is a side view of the glue application device along the line III—III in FIG. 1.

FIG. 3 shows that the lower region of the glue chamber 1 is provided with an opening 20 for supplying the glue and an opening 21 for discharging the glue. The strip 16 is widened from its lower end in the direction toward the bottom of the glue chamber 1, as indicated by the broken line 22, so as to take into consideration the increase in the hydrostatic pressure. The adhesive roller 4 and the sealing rollers 6 are provided with upper shaft journals 23, 24 arranged in an upper bearing plate 25 as schematically indicated in this figure.

What is claimed is:

1. A device for applying an adhesive comprising:

an adhesive chamber defined within a pair of vertical side walls and a vertical bottom wall, an adhesive roller having a first vertical rotational axis and partially closing a front side of said adhesive chamber, said adhesive roller, in cooperation with one of said pair of vertical side walls, limiting a return gap for unremoved adhesive, a sealing roller having a second vertical rotational axis which is arranged parallel to the first vertical rotational axis of the adhesive roller and also partially closing said front side of said adhesive chamber, a drive system which rotates said adhesive roller and said sealing roller in the same direction about the first vertical rotational axis and the second vertical rotational axis, respectively, an adhesive applicator roller having a third vertical rotational axis which is arranged parallel to the first and second rotational axes and which adjoins said adhesive roller, the sealing roller forming a gap for the adhesive in cooperation with the adhesive application roller, sealing elements for sealing said sealing roller relative to another of said pair of vertical side walls, said adhesive applicator roller being adjustable such that said adhesive application roller adjoins the adhesive roller and transfers glue sections to work pieces on which glue needs to be applied, and a strip of flexible material fastened to the one of said pair of vertical side walls that limits the return gap, a free end of said strip adjoining a surface region of the adhesive roller which enters the chamber.

2. A device for applying an adhesive according to claim 1, characterized in that the strip consists of elastomer material.

3. A device for applying an adhesive according to claim 1, characterized in that the strip is widened from an upper side of the chamber toward a bottom of the chamber.

4. A device for applying an adhesive according to claim 2, characterized in that the strip is widened from an upper side of the chamber toward a bottom of the chamber.

* * * * *